United States Patent [19]

Nishizawa

[11] Patent Number: 4,487,426

[45] Date of Patent: Dec. 11, 1984

[54] SKI

[75] Inventor: Akitoshi Nishizawa, Nagano, Japan

[73] Assignee: Kabushikigaisha Nishizawa, Tokyo, Japan

[21] Appl. No.: 378,992

[22] Filed: May 17, 1982

[30] Foreign Application Priority Data

| | | | |
|---|---|---|---|
| Jun. 8, 1981 | [JP] | Japan | 56-84559[U] |
| Mar. 3, 1982 | [JP] | Japan | 57-30106[U] |
| Mar. 18, 1982 | [JP] | Japan | 57-37234[U] |

[51] Int. Cl.[3] ..... A63C 5/04

[52] U.S. Cl. ..... 280/609

[58] Field of Search ..... 280/601, 609, 600, 602; 441/68

[56] References Cited

U.S. PATENT DOCUMENTS

| | | | |
|---|---|---|---|
| 2,510,794 | 6/1950 | Beerli | 280/609 |
| 3,404,900 | 10/1968 | Rippetoe | 280/609 |
| 3,534,972 | 10/1970 | Salerno | 280/609 |
| 3,933,360 | 1/1976 | Arai | 280/601 |
| 4,377,297 | 3/1983 | Staufer | 280/609 |

FOREIGN PATENT DOCUMENTS

| | | | |
|---|---|---|---|
| 118652 | 3/1930 | Austria | 280/609 |
| 140262 | 1/1935 | Austria | 280/601 |
| 944646 | 4/1949 | France | 280/609 |
| 1193933 | 11/1959 | France | 280/609 |
| 88426 | 2/1937 | Sweden | 280/609 |

OTHER PUBLICATIONS

"International Standard ISO 5901", First Edition, Aug. 1, 1980.

*Primary Examiner*—David M. Mitchell
*Assistant Examiner*—Michael Mar
*Attorney, Agent, or Firm*—Schwartz, Jeffery, Schwaab, Mack, Blumenthal & Koch

[57] ABSTRACT

The ski includes a front ski half extending from the front ground line to the middle part, a rear ski half extending from the middle part to the rear ground line, a gliding surface and a boot mounting area. The right and left side contours of the front ski half are formed in plan into outwardly-bulging curves, more preferably into arcuate curves relative to the longitudinal center line of the ski.

12 Claims, 12 Drawing Figures

PRIOR ART FIG. 9
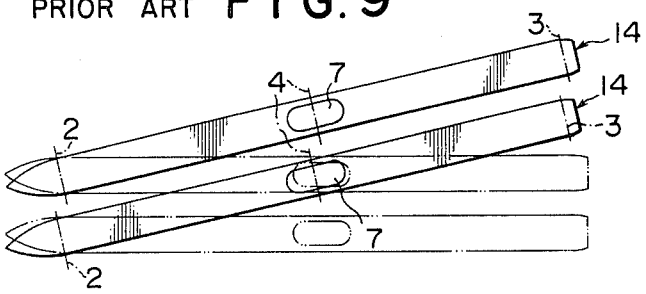
FIG. 10
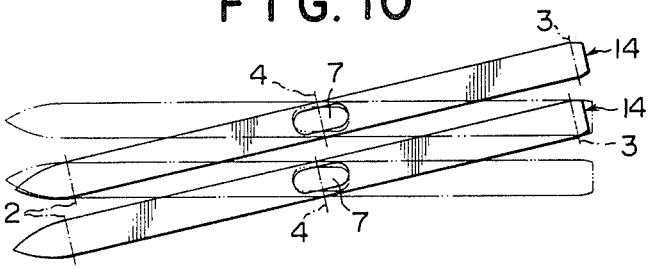
PRIOR ART
FIG. 11
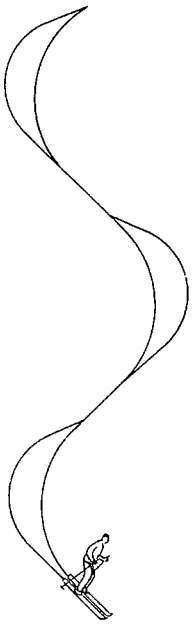
FIG. 12
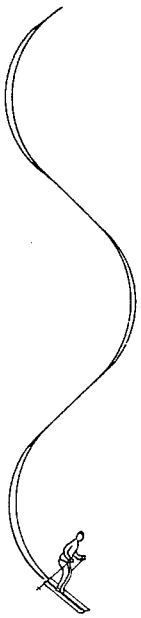

SKI

BACKGROUND OF THE INVENTION (a) Field of the Invention

This invention relates to an improvement in or relating to the configuration of a ski so as to provide skis which are readily turnable by not only advanced skiers but also beginners and those having weak leg strength.

(b) Description of the Prior Art

As apparent from FIG. 1 which illustrates in plan a conventional ski, the prior art ski has a front ski half extending between the front ground line 2, which is in contact with a horizontal plane 10 in a front part of the ski, and the middle part 4; a rear ski half extending from the middle part 4 to the rear ground line 3 lying in the horizontal plane 10 in a rear part of the ski; a gliding surface 9; and a boot-binding part 7 located substantially at the same point as the middle part 4 and adapted to permit a skier to mount his foot thereon upon using the ski. More specifically, the ski is, as seen in plan, broadest at the ski shoulder in the vicinity of the front ground line, narrowest at the ski waist around the middle part along the length of the ski, and has a width approximately intermediate of the widths at the former two locations at the ski heel near the rear ground line 3. The right and left contours 5, 6 define at each side of the ski an inwardly-indented gentle curve between the front ground line 2 and rear ground line 3, which curve has a radius of about 50–55 m or so. As readily seen from FIG. 2, which is a side elevation of the above conventional ski, the gliding surface 9 of the ski lies in the horizontal plane 10 at two points, i.e., at the front ground line 2 and rear ground line 3. Its middle part 7 is defined by an arch-like curve havin a weight bottom camber 11 of about 3.0–18.00 mm. Thus, the gliding surface 9 is upwardly spaced from the horizontal plane 10, in other words, the chord joining the front ground line 2 and rear ground line 3 when the ski is unoccupied.

Skis of the above-mentioned type, however, require a high degree of complex technique such as body weaving, weight exertion and release at the weight bottom camber 11, stepping-in, and timing when making a turn thereon. Such prior art skis are accompanied by another drawback that, due to the formation of the weight bottom camber 11 at the boot-binding part 4, great leg strength is required to enable each of them to touch the snow along its length. This is because of the repulsive force developed by the springiness stemming from the lengthwise arched structure of the ski. Strain, tension, etc. are even when a skier's weight is exerted thereon, thereby making ski-handling difficult for those lacking such great leg strength.

To change the skiing direction upon making a turn on such conventional skis, it is necessary, as envisaged from FIG. 9, which illustrates in plan positions of the conventional skis, in the course of making a turn, to push upwardly and draw the rear portion of the ski strip, i.e., the outer side contour 6 of the rear ski half 13 in the vicinity of the rear ground line 3, while using the front ground line 2 as the center of the turning motion. This forces the skier to uncomfortably shift his heels from each other, thereby casting an extra, undue burden to his waist, knees and arms so as to maintain balance. With such prior art skis, it is also necessary for a skier to intentionally push the ski tails outwardly whenever he tries to make a turn. This renders it difficult for the skier to maintain balance because his gravity center tends to shift from the ski strips in the course of each turning motion. To cope with this inconvenience, the skier is required to glide down over the snow while making uncomfortable waist, knee and arm positions.

In the early stage of each turning motion (i.e., introductory stage), it is also necessary with conventional skis to make a turn using complex body motion in which the skier is required to repeatedly exert and release his body weight relative to the skis by bending and stretching his legs. In the later stage of each turning motion, conventional skis require a high degree of skiing technique including undue edging and excessive rocking to avoid oversliding of the ski tails, notably on the packed snow, on frozen ski slopes and the like. As a result, such conventional skis draw considerably serpentine zigzag lines as shown in FIG. 11 which illustrates the tracks left in the snow when a skier glided downhill, thereby forcing the skier to expend more energy.

SUMMARY OF THE INVENTION

With the foregoing in mind, the present invention obvitates the aforementioned drawbacks of conventional skis by, in a ski including a front ski half extending from the front ground line to the middle part, the rear ski half extending from a middle part to the rear ground line, a gliding surface and a boot-binding part, forming the right and left side contours of the front ski half into outwardly-bulging curves relative to the longitudinal center line of the ski as seen in plan. Accordingly, an object of this invention is to provide skis of the above type, which permit easy turning with simple skiing skill even for those having relatively weak leg strength.

According to one aspect of this invention, there is thus provided a ski including the front ski half extending from the front ground line to the middle part, the rear ski half extending from the middle part to the rear ground line, a gliding surface and a boot-binding part, in which ski the right and left side contours of the front ski half are formed in plan into outwardly-bulging curves relative to the longitudinal centerline of the ski.

The present invention can bring about such an effect that, owing to the adoption of the aforementioned structure, not only advanced skiers but also even those having light weight and/or insufficient leg strength such as youths and women as well as unskilled skiers such as beginners can make simple and stable turns by slight shifting of thier gravity centers and changing of their body directions without need for a high degree of complex skiing technique, which has been considered indispensable for downhill surpentine glides, such as body weaving, weight exertion and release, and stepping-in and their timing.

The above and other objects, features and advantages of the present invention will become apparent from the following description and the appended claims, taken in conjunction with the accompanying drawings.

BRIEF DESCRIPTION OF THE DRAWINGS

In the accompanying drawings:

FIG. 9 is a plan view showing turning directions of conventional skis in the course of making a turn;

FIG. 10 is similar to FIG. 9, but shows turning directions of skiis according to this invention;

FIG. 11 is a plan view showing the tracks of conventional skis left in the snow upon making turns thereon; and FIG. 12 is a plan view showing the tracks of skis according to this invention drawn in the snow upon making turns thereon.

DETAILED DESCRIPTION OF THE PREFERRED EMBODIMENTS

Figure 1:
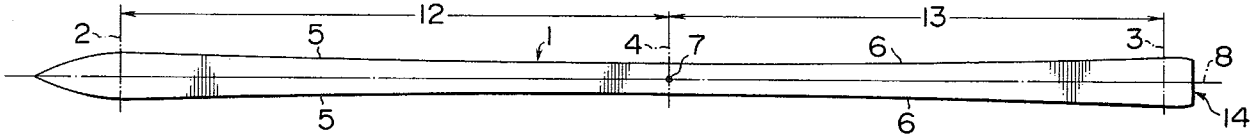
FIG. 1 PRIOR ART
FIG. 1 is a plan view of a conventional ski.
Figure 2:
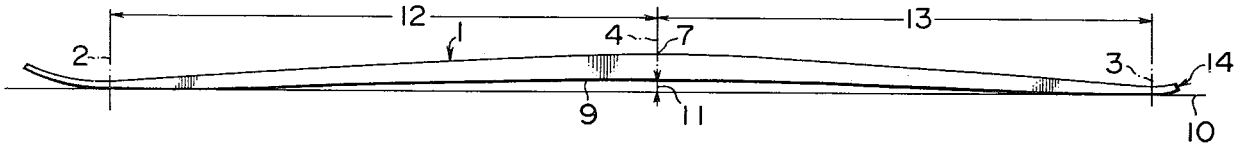
FIG. 2 PRIOR ART
FIG. 2 is a side elevation of the conventional ski.
Figure 3:
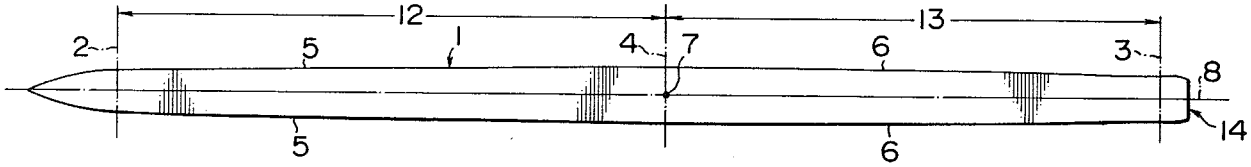
FIG. 3 is a plan view of a ski according to one embodiment of this invention.
Figure 4:
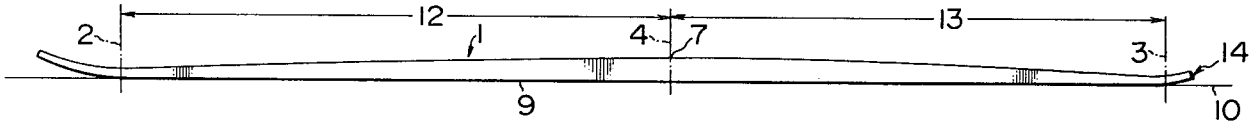
FIG. 4 is a side view of the ski shown in FIG. 3.
Figure 5:
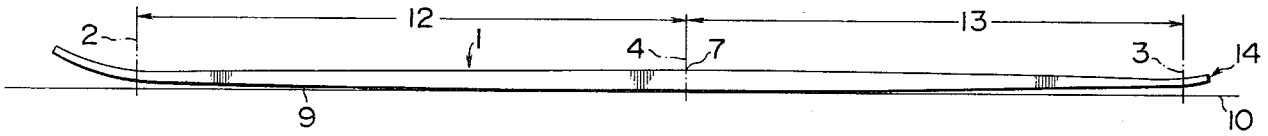
FIGS. 5 and 6 are side elevations of skis according to other embodiments of this invention, respectively.
Figure 6:
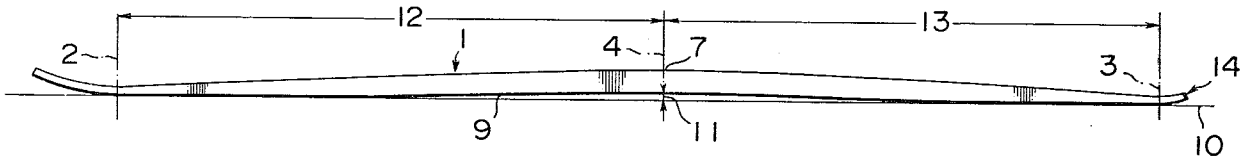

Referring first to FIGS. 3 and 4 which illustrate one embodiment of this invention, a ski is generally designated at numeral 1. The ski 1 is made of a desired combination of synthetic resins such as thermoplastic resins and thermosetting resins, plywood, laminated wood, foamed resins, metals such as aluminum alloys, hardened steel wires, glass fibers, rubber, synthetic resin-base adhesives, synthetic resin-base paints, etc. Numerals 2 and 3 indicate, respectively, the front ground line and rear ground line. The front ground line 2 indicates a point where the front part of a conventional ski contacts the horizontal plane, i.e., the chord joining the front ground line 2 and rear ground line 3. Thus, by the term "rear ground line 2" is meant a point where the rear part of the conventional ski contacts the horizontal plane. Numeral 4 represents the middle part, while the right and left contours of the front ski half 12 extending from the front ground line 2 to the middle part 4 are designated respectively at numerals 5, 5. On the other hand, the right and left side contours of the rear ski half 13 extending from the middle part 4 to the rear ground line 3 are shown respectively at numeral 6, 6. Both right and left side contours 5, 5, 6, 6 include corresponding edges made of a metal or the like. At numeral 7, a boot-binding part is indicated. A skier puts his foot on the boot-binding part 7 when gliding over the snow. The boot-binding part 7 is located substantially at the same place as the middle part 4. Numeral 8 designates the longitudinal center line of the ski 1. In the plan view, the left and right side contours 5 of the front ski half 12 are formed into outwardly-bulging curves which are symmetrical to each other relative to the longitudinal center line 8 of the ski 1. In this embodiment, these outwardly-bulging curves extend continuously with the outwardly-bulging curves of their corresponding right and left side contours 6, 6 of the rear ski half 13, thereby forming arcuate curves as a whole. Each of the arcuate curves may be an arc of either a circle or an ellipse. In the case of a circle, it generally has a radius in the range of 190–210 m, preferably 195–205 m and more preferably of about 199 m. The arcuate curve may be the arc of any circle having a radius within a suitable range. The arcuate curves may also contain straight portions at the middle parts thereof. For example, supposing that a ski has an overall length (lN) of 204 cm, the opposite side edge portions which extend between points at 85 cm and 100 cm, respectively, from the ski tail 14, may be formed into straight lines. The gliding surface 9 of the above-exemplified embodiment may be formed, as seen in side elevation i.e., as illustrated in FIGS. 4 and 5, such that it contacts with the horizontal plane 10 at least at a point corresponding the boot-binding part 7. In FIG. 4, the gliding surface 9 is planar from the front ground line 2 to the rear ground line 3. Another example of the ski configuration as seen in side elevation is shown in FIG. 5, in which the front ground line 2 and rear ground line 3 are both located at a height of 3.0 mm from the horizontal plane 10 so as to define a convex surface gently curved relative to the length of the ski. In both FIGS. 4 and 5, the front ground line 2 and rear ground line 3 do not contact, precisely speaking, with the horizontal plane 10 even when placed thereon. In this embodiment, the gliding surface 9 may be formed, as shown in FIG. 6, in such a way that it does not contact at least at the point corresponding the boot-binding part 7 when placed on the horizontal plane (ruling table) 10 in an unoccupied state. In this case, its weight bottom chamber 11 may desirously range from 0 mm to 3.0 mm or so. The provision of such a bottom weight camber seldom deleteriously affects the merits achieved by the characteristic configurations of a ski according to the present invention.

Figure 7:
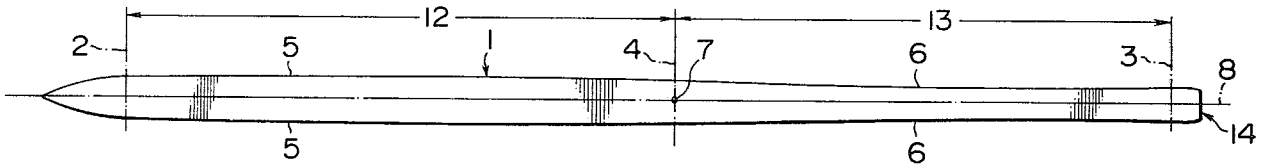
FIGS. 7 and 8 are, respectively, plan views of skis according to still other embodiments of this invention.

In FIG. 7, the ski has the same configurations, as seen in plan, as in FIG. 3 but the right and left side contours 6, 6 of the rear ski half 13 define inwardly-indented curves, respectively, relative to the longitudinal center line of the ski. The right and left side contours 5, 5 of the front ski half 12 are continuously connected in the form of outwardly-bulging curves to the inwardly-indented curves near the middle part 4. Here, the radius of each of the outwardly-bulging curves may range from 160–200 m, preferably 175–190 m, and more preferably 183 m or so. The inwardly-indented curves are preferably substantially close to straight lines. The outwardly-bulging curves and inwardly-indented curves may be connected either directly or through corresponding straight side edge portions. An example of a ski having an outwardly-bulging curve and inwardly-indented curve connected continuously through a straight side edge portion, is a ski having an overall length (lN) of 208 cm and including opposite straight side edge portions extending between two points at 85 cm and 105 cm respectively, from the ski tail.

Figure 8:
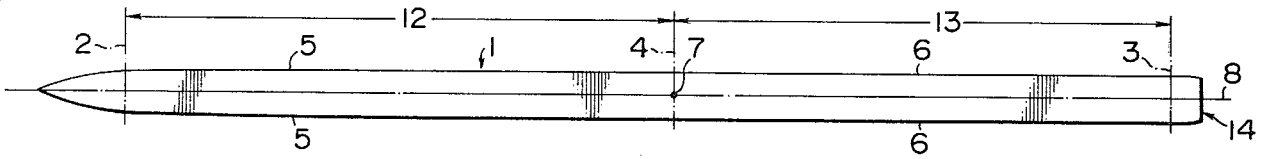

Now, reference is made to FIG. 8, in which there is shown in plan a ski which is similar to that illustrated in FIG. 3 except that the right and left side contours 6, 6 of the rear ski half 13 are straight relative to the longitudinal center line 8. The right and left side contours 5, 5 of the front ski half 12 join their corresponding straight side contours 6, 6 near the middle part 4. In this case, the radius of each of the curves 5, 5 may range from 160–200 m, preferably 175–190 m, and more preferably 183 m or so.

Now, the operation of the skis exemplified above is described. Since the right and left side contours 5, 5 of the front ski half 12 define outwardly-bulging curves, the front ski half 12 of the outer ski which is more loaded upon making a turn shows tendency to turn in the intended direction about the boot-binding part 7, thereby permitting the ski to smoothly enter the turning curve from its leading end and allowing a smooth turn.

A change in direction using the skis according to the present invention may be made as shown in FIG. 10, which shows the ski positions while making a turn on them. Namely, the turn is carried out by directing the front ground line 2 of each ski using the boot-binding part 7 as the center of the turning motion. This permits a skier to readily make a turn in a short time period while maintaining a comfortable body position and maintaining his waist at a position relatively higher than that required when conventional skis are used. Thus, the skier is allowed to assume a suitable position for the next turn and avoid meaningless use of energy. Since the skier is allowed to maintain a rather raised style, in other words, to keep center of gravity of his body weight at a comfortable position, the center of gravity will not be shifted from a position above the skis. In the early stage of the turning motion (i.e., introductory stage), the skier is able to figure out easily and precisely the timing of each turn well before the time at which he has to start the turning operation of his skis. The skis according to this invention can be easily turned in desired directions with the aid of the natural cutting-in movement of thier leading ends. This avoids the need for weight release to be effected by bending or stretching the skier's legs. In the later part of the turn, it is unnecessary for the skier to assume a crouched style with forward lean in view of the nature of the snow or the hardness of the frozen ski slope. This permits the skier to maintain a comfortable position and to use less energy. Furthermore, the skier can keep a straight glide longer subsequent to each turn because he is allowed to figure out the timing of the subsequent turn well before he reaches a critical point for starting the subsequent turn, thereby allowing the skier to make ideal ski lines in the snow with less effort. Owing to this feature, the lines or tracks of skis according to this invention will become closer to straight lines compared with those obtained from conventional skis as illustrated in FIG. 10. Accordingly, skiers can make easy turns when gliding downhill on skis according to this invention.

Where the right and left side contours 5, 6 of a ski are both formed into outwardly-bulging curves as shown in FIG. 3, the ski is prevented from becoming broader at its shoulder portion near the front ground line 2, contrary to conventional skis. This permits skiers to make turns in slalom while bringing the leading end portions of their skis very close to flagged poles and, at the same time, minimizing the turning arcs. Thus, skis according to this invention permit quick and small turns and thus are ideal for slalom which requires repeated quick and small turns. Where the right and left side contours 5 of the front ski half 12 are formed into outwardly-bulging curves while the right and and left side contours 6 of the rear ski half 13 are formed into inwardly-indented curves, as illustrated in FIG. 7, the ski shoulder portion is prevented from getting broader contrary to prior art skis. Here again, skiers can make turns while allowing the leading end portions of their skis to approach very close to flagged poles. Owing to the inwardly-indented curves of the right and left side contours 6 of the rear ski half 13 of the skis in FIG. 7, their turning arcs are greater than those available from the use of skis shown in FIG. 3 but they bring about faster gliding speeds, thereby making them suitable for use in giant slalom. Next, reference is made to FIG. 8 in which the right and left side contours 5 of the front ski half 12 of a ski are formed into outwardly-bulging curves while straight lines are defined by the side contours 6 of its rear ski half 13. Skis of this sort are suited for downhill competitions.

Where a ski has a side elevation configuration as shown in FIG. 4 or 5, the gliding surface 9 is in contact with the horizontal plane 10 when the ski is unoccupied. This is from conventional skis which have an arched gliding surface which defines the weight bottom camber 11. With the present invention, skiers, including light weight people such as youths and women, those having weak leg strength and unskilled skiers such as beginners and the like, can make turns easily about the boot-binding parts 7 with only slight weight shifts and body rotations. There is no need for such skiing techniques as strong weight exertion and release and swinging.

Where a ski has, in side elevation, a configuration as shown in FIG. 6, the gliding surface 9 is not in contact with the horizontal plane 10 at the boot-binding part 7 when the ski is unoccupied. Skis of this type are capable of absorbing any excessive stepping-in of skiers' legs, which may be caused upon making turns, owing to the provision of the weight bottom camber 11. This feature permits advanced skiers having strong legs to easily make turns about the boot-binding parts 7 through slight weight shifts and body rotations without deleteriously affecting the advantages derived from the characteristic configurations of the skis according to the present invention and without the need for such skiing techniques as strong weight exertion and release and swinging, which techniques are indispensable for prior art skis having an arched gliding surface which in turn defines a weight bottom camber of 3.0–18.0 mm. The characteristic features stemming from the ski configurations according to the present invention will seldom be lost, particularly where the weight bottom camber 11 is on the order of 3.0 mm or so.

Now, various dimensions of skis having a configuration as illustrated in FIG. 3 and having a configuration as depicted in FIG. 7 are tabulated, respectively, in Table 1 and Table 2. In tables 1 and 2, the abbreviations (bv), (bM) and (bH) mean respectively the width of the gliding surface of each ski at its front ground line, the width of the middle part of each ski, especially at a location where the gliding surface has the broadest width, and the width of the gliding surface of each ski at its rear ground line.

The dimensions of some of these skis are shown together in Table 3 for the sake of comparison. In Table 3, the abbreviations (bv), (bM) and (bH) have the same significance as in Tables 1 and 2. Incidentally, the abbreviation (bM) indicates the ski waist width in conventional skis whereas the abbreviation (bH) means the ski heel width in conventional skis.

TABLE 1

| Ski length (lN) | (bV) | (bM) | (bH) |
|---|---|---|---|
| 209 cm | 67.2 mm | 70.2 mm | 67.2 mm |
| 204 cm | 67.0 mm | 70.0 mm | 67.0 mm |
| 199 cm | 66.8 mm | 69.0 mm | 66.8 mm |
| 194 cm | 66.6 mm | 69.6 mm | 66.8 mm |
| 189 cm | 66.4 mm | 69.4 mm | 66.4 mm |
| 184 cm | 66.2 mm | 69.2 mm | 66.2 mm |
| 179 cm | 66.0 mm | 69.0 mm | 66.0 mm |

TABLE 2

| Ski length (lN) | (bV) | (bM) | (bH) |
|---|---|---|---|
| 213 cm | 67.2 mm | 70.2 mm | 75.2 mm |
| 208 cm | 67.0 mm | 70.0 mm | 75.0 mm |
| 203 cm | 66.8 mm | 69.8 mm | 74.8 mm |
| 198 cm | 66.6 mm | 69.6 mm | 74.6 mm |
| 193 cm | 66.4 mm | 69.4 mm | 74.4 mm |
| 188 cm | 66.2 mm | 69.2 mm | 74.2 mm |
| 183 cm | 66.0 mm | 69.0 mm | 74.0 mm |

TABLE 3

| | (bV) | (bM) | (bH) |
|---|---|---|---|
| (1) Ski size (lN) = 203 cm | | | |
| Prior art ski | 87.3 mm | 68.4 mm | 77.3 mm |
| Ski in FIG. 3 | 67.1 mm | 70.1 mm | 67.1 mm |

TABLE 3-continued

| | (bV) | (bM) | (bH) |
|---|---|---|---|
| Ski in FIG. 7 | 67.0 mm | 70.0 mm | 75.0 mm |
| (2) Ski size (lN) = 200 cm | | | |
| Prior art ski | 86.5 mm | 67.6 mm | 76.5 mm |
| Ski in FIG. 3 | 66.8 mm | 69.8 mm | 66.8 mm |
| Ski in FIG. 7 | 66.7 mm | 69.7 mm | 74.7 mm |
| (3) Ski size (lN) = 190 cm | | | |
| Prior art ski | 85.5 mm | 66.6 mm | 75.5 mm |
| Ski in FIG. 3 | 66.4 mm | 69.4 mm | 66.4 mm |
| Ski in FIG. 7 | 66.3 mm | 69.3 mm | 74.3 mm |

Having now fully described the invention, it will be apparent to one of ordinary skill in the art that many changes and modifications can be made thereto without departing from the spirit or scope of the invention as set forth herein.

What is claimed is:

1. A ski having an overall length of 1790 mm to 2130 mm, comprising:

a front ski half extending from a front tip portion to a middle part, said front ski half including a shovel portion and a front ground line defined at the transition between said shovel portion and the remainder of the ski, said front ground line having a width of 66 mm to 67.2 mm, and said middle part having a width of 69 mm to 70.2 mm;

a rear ski half extending from the middle part to a tail portion and including a rear ground line defined at the transition between said tail portion and the remainder of the ski;

a gliding surface; and a boot-binding part, wherein said front ski half includes right and left side contours formed in plan into outwardly-bulging curves relative to a longitudinal center line of said ski, and wherein the width of said front ski half increases from said front ground line to said middle part; and wherein said ski comprises one of a pair of similar skis adapted to be attached to opposite feet of a skier.

2. The ski as claimed in claim 1, wherein said outwardly-bulging curves are arcuate curves.

3. The ski as claimed in claim 2, wherein said gliding surface has a configuration in a side view of said ski that said gliding surface lies at a point corresponding said boot-binding part on a chord joining said front ground line and rear ground line.

4. The ski as claimed in claim 3, wherein said gliding surface is plane, as seen in the side view of said ski, between said front groundline and rear ground line.

5. The ski as claimed in claim 3, wherein said gliding surface defines a convex surface, as seen in the side view of said ski, between said front ground line and rear ground line relative to said chord joining both lines.

6. The ski as claimed in claim 4 or 5, wherein the right and left side contours of said rear ski half are formed in plan into outwardly-bulging curves relative to the longitudinal center line of said ski.

7. The ski as claimed in claim 4 or 5, wherein the right and left side contours of said rear ski half are formed in plan into straight lines relative to the longitudinal center line of said ski.

8. The ski as claimed in claim 4 or 5, wherein the right and left side contours of said rear ski half are formed in plan into inwardly-indent curves relative to the longitudinal center line of said ski.

9. The ski as claimed in claim 2, wherein said gliding surface is upwardly spaced, as seen in a side view of said ski, from a chord joining said front ground line and rear ground line when said ski is unoccupied.

10. The ski as claimed in claim 9, wherein the right and left side contours of said rear ski half are formed in plan into outwardly-bulging curves relative to the longitudinal centerline of said ski.

11. The ski as claimed in claim 9, wherein the right and left side contours of said rear ski half are formed in plan into straight lines relative to the longitudinal centerline of said ski.

12. The ski as claimed in claim 9, wherein the right and left side contours of said rear ski half are formed in plan into inwardly-indent curves relative to the longitudinal center line of said ski.

* * * * *